US009590327B2

(12) United States Patent
Matsuno

(10) Patent No.: US 9,590,327 B2
(45) Date of Patent: Mar. 7, 2017

(54) REINFORCING METAL FITTING AND A CONNECTOR HAVING THE REINFORCING METAL FITTING

(71) Applicant: Molex, LLC, Lisle, IL (US)

(72) Inventor: Genki Matsuno, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/052,375

(22) Filed: Feb. 24, 2016

(65) Prior Publication Data

US 2016/0294082 A1 Oct. 6, 2016

(30) Foreign Application Priority Data

Mar. 30, 2015 (JP) ..... 2015-068122

(51) Int. Cl.

| | |
|---|---|
| ***H01R 12/00*** | (2006.01) |
| ***H01R 12/70*** | (2011.01) |
| ***H01R 12/71*** | (2011.01) |
| ***H01R 13/627*** | (2006.01) |
| *H01R 107/00* | (2006.01) |

(52) U.S. Cl.

CPC ..... *H01R 12/7005* (2013.01); *H01R 12/716* (2013.01); *H01R 13/6275* (2013.01); *H01R 2107/00* (2013.01)

(58) Field of Classification Search

USPC ..... 439/74

See application file for complete search history.

(56) References Cited

U.S. PATENT DOCUMENTS

| | | | | |
|---|---|---|---|---|
| 6,866,522 | B2 * | 3/2005 | Terashima | H01R 12/716 439/74 |
| 7,172,434 | B2 | 2/2007 | Obikane et al. | |
| 7,766,666 | B1 * | 8/2010 | Chen | H01R 13/20 439/65 |
| 7,845,958 | B2 * | 12/2010 | Hoshino | H01R 12/716 439/660 |
| 7,901,218 | B2 * | 3/2011 | Sato | H01R 12/716 439/74 |
| 8,292,635 | B2 * | 10/2012 | Little | H01R 12/7029 439/570 |

FOREIGN PATENT DOCUMENTS

JP 2007-323854 A 12/2007

* cited by examiner

*Primary Examiner* — Tho D Ta
(74) *Attorney, Agent, or Firm* — James A. O'Malley

(57) ABSTRACT

A connector is provided which includes a connector main body, terminals mounted in the connector main body, and a reinforcing metal fitting mounted in the connector main body. The connector main body includes mating guide portions formed at both ends longitudinally. The mating guide portions configured to mate with mating guide portions of another connector. The reinforcing metal fitting including an engaging protruding portion whose leading end portion is configured to engage with an engaging portion on the other connector. A portion of the reinforcing metal fitting, which portion includes at least the leading end portion of the engaging protruding portion, protrudes from a wall surface of one of the mating guide portions.

24 Claims, 10 Drawing Sheets

REINFORCING METAL FITTING AND A CONNECTOR HAVING THE REINFORCING METAL FITTING

RELATED APPLICATIONS

This application claims priority to Japanese Application No. 2015-068122, filed Mar. 30, 2015, which is incorporated herein by reference in its entirety.

TECHNICAL FIELD

The present disclosure relates to a connector.

BACKGROUND ART

Board-to-board connectors are used to electrically connect a pair of parallel circuit boards. These board-to-board connectors are mounted on the surfaces of the pair of circuit boards facing each other, and then mated to establish an electrical connection. Reinforcing metal fittings have been proposed which are mounted on both ends to function as locking members for keeping the two connectors mated (see, for example, Patent Document 1).

In FIG. 10B, 851 is the first reinforcing metal fitting attached to both ends in the longitudinal direction of the housing of the first connector mounted on a first circuit board (not shown). In FIG. 10A, 951 is the second reinforcing metal fitting attached to both ends in the longitudinal direction of the housing of the second connector mounted on a second circuit board (not shown).

The first reinforcing metal fitting 851 is a component integrally formed by stamping and bending a metal sheet, and includes a panel-shaped main body portion 852 extending in the transverse direction of the first connector, a side engaging pieces 858 extending from both ends of the main body portion 852 in the longitudinal direction of the first connector, a board connecting portion 856 connected to the bottom ends of the side engaging piece 858 and soldered securely to the first circuit board, side engaging protruding portion 858*a* soldered securely to the first circuit board connected to the bottom ends of the side engaging pieces 858, and a housing engaging protruding portion 854 formed on the leading end of each side engaging piece 858.

The second reinforcing metal fitting 951 is a component integrally formed by stamping and bending a metal sheet, and includes a panel-shaped main body portion 952 extending in the transverse direction of the second connector, a side engaging piece 958 extending outward in the transverse direction of the second connector from both the left and right ends of the main body portion 952, a side engaging protruding portion 958*a* formed on the leading end of each side engaging piece 958, a board connecting portion 956 soldered securely to the second circuit board connected to the bottom end of the main body portion 952 (the upper end from the perspective of the drawing), and housing engaging protruding portions 952*a* formed on a surface of the main body portion 952.

When the first connector and the second connector are mated, the side engaging protruding portions 858*a* of the first reinforcing metal fitting 851 and the side engaging protruding portions 958*a* of the second reinforcing metal fitting 951 engage each other to lock the first connector and the second connector and keep them mated.

Patent Document 1—Laid-Open Patent Publication No. 2009-277365

SUMMARY

However, when the connectors of the prior art are unmated, that is, when the first connector and the second connector are unmated, the side engaging piece 958 of the second reinforcing metal fitting 951 is deformed and becomes turned up. When the first connector and the second connector are unmated, the force disengaging the side engaging protruding portion 858*a* of the first reinforcing metal fitting 851 and the side engaging protruding portion 958*a* of the second reinforcing metal fitting 951 is the same, but the side engaging protruding portion 858*a* of the first reinforcing metal fitting 851 is closer to the board connecting portion 856 secured to the first circuit board than the side engaging protruding portion 958*a* of the second reinforcing metal fitting 951 is to the main body portion 952 secured to the housing and the second circuit board. As a result, the side engaging piece 958 connected to the main body portion 952 and the side engaging protruding portion 958*a* is subjected to more force.

The present disclosure seeks to improve the reliability of a connector without deforming the reinforcing metal fitting during mating and unmating by having an engaging protruding portion on the reinforcing metal fitting arranged in a mating guide portion at both ends of the connector main body in the longitudinal direction protrude from a wall surface of the mating guide portion.

The present disclosure is an embodiment of a connector comprising a connector main body, terminals mounted in the connector main body, and a reinforcing metal fitting mounted in the connector main body; the connector main body including mating guide portions formed at both ends longitudinally and mating with the mating guide portions formed at both ends longitudinally in the connector main body of another connector; the reinforcing metal fitting including an engaging protruding portion whose leading end portion engages an engaging portion on a reinforcing metal fitting mounted in the other connector main body; and a portion including at least the leading end portion of the engaging protruding portion protrudes from a wall surface of the mating guide portion.

In another embodiment of a connector of the present disclosure, at least a portion of the mating surface of the connector main body on the periphery of the engaging protruding portion is covered by the insulating material forming the mating guide portion.

In another embodiment of a connector of the present disclosure, a recessed portion is formed in at least a portion of the wall surface on the periphery of the engaging protruding portion.

In another embodiment of a connector of the present disclosure, the connector main body is formed so at least a portion surrounding the reinforcing metal fitting is covered by and integrated with an insulating material.

In another embodiment of a connector of the present disclosure, the wall surface is an outer wall surface of a side wall portion of the mating guide portion, the other mating guide portion includes a mating recessed portion for receiving the inserted mating guide portion, the other reinforcing metal fitting includes an inner wall portion covering an inner surface of the mating recessed portion, and the other engaging portion is a recessed portion formed in the inner wall portion.

In another embodiment of a connector of the present disclosure, an engaging protruding portion on the reinforcing metal fitting arranged in a mating guide portion at both ends of the connector main body in the longitudinal direction protrudes from a wall surface of the mating guide portion. As a result, reliability can be improved without deforming the reinforcing metal fitting during mating and unmating.

BRIEF DESCRIPTION OF THE DRAWINGS

FIGS. 1A and 1B are perspective views of the first connector in an embodiment of the present disclosure in which FIG. 1A is a perspective view from above and FIG. 1B is a perspective view from below.

FIGS. 3A and 3B are perspective views of the first reinforcing metal fitting of the first connector in an embodiment of the present disclosure in which FIG. 3A is a perspective view from above and FIG. 3B is a perspective view from below.

FIGS. 4A and 4B are perspective views of the second connector in an embodiment of the present disclosure in which FIG. 4A is a perspective view from above and FIG. 4B is a perspective view from below.

FIGS. 6A and 6B are perspective views of the second reinforcing metal fitting of the second connector in an embodiment of the present disclosure in which FIG. 6A is a perspective view from above and FIG. 6B is a perspective view from below.

FIGS. 8A and 8B are perspective views showing the connectors in an embodiment of the present disclosure after the mating operation has been completed in which FIG. 8A is a view from the second connector and FIG. 8B is a view from the first connector.

FIGS. 9A and 9B are a pair of views showing the connectors in an embodiment of the present disclosure after the mating operation has been completed in which FIG. 9A is a side view and FIG. 9B is a cross-sectional view from A-A in FIG. 9A.

FIGS. 10A and 10B are perspective views of reinforcing metal fittings of the prior art in which FIG. 10A is a view of the second reinforcing metal fitting and FIG. 10B is a view of the first reinforcing metal fitting.

DETAILED DESCRIPTION OF THE PREFERRED EMBODIMENTS

Figure 1A:
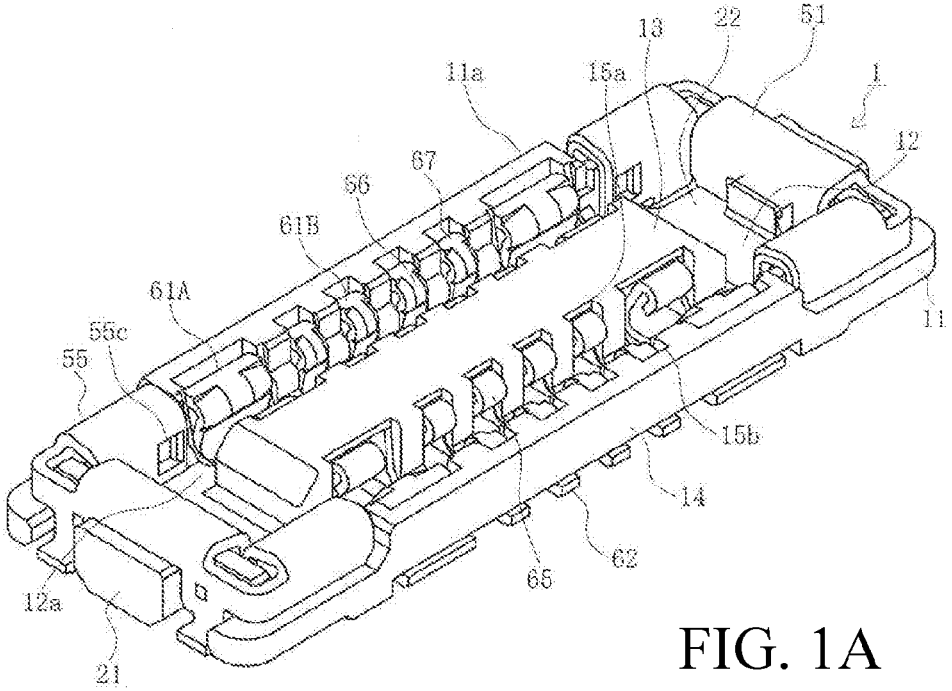

The following is a more detailed explanation of an embodiment of the present disclosure with reference to the drawings.

With reference to FIGS. 1A, 1B, 2, 3A and 3B, 1 is the first connector which is one of the pair of board-to-board connectors in the present embodiment. The first connector 1 is a surface mounted connector which is mounted on the surface of a first board (not shown), and mated with another connector or the second connector 101 described below. Also, the second connector 101 is the other one of the pair of board-to-board connectors in the present embodiment. This is also a surface mounted connector mounted on the surface of a second board (not shown).

The first connector 1 and the second connector 101 in the present embodiment preferably establish an electrical connection between the first board and the second board. The first board and the second board can also be printed circuit boards used in electronic devices, flexible flat cables (FFC), flexible printed circuit (FPC) boards, or any other type of board.

In the present embodiment, the expressions indicating direction, such as upper, lower, left, right, front and rear, which are used to explain the configuration and operation of each portion of the first connector 1 and the second connector 101, are relative and not absolute. They depend on the orientation of the connectors and their constituent components shown in the drawings. When the orientation of the first connector 1, the second connector 101 or their constituent components changes, the interpretation changes in response to the change in orientation.

The first connector 1 has a first housing 11, which is an integrally molded connector main body made of an insulating material such as a synthetic resin. As shown in the drawings, the first housing 11 has a rectangular thick panel-like shape, and has a rectangular recessed portion 12 with a surrounded perimeter formed on the side receiving the inserted second connector 101, that is, the mating surface 11*a* side (the upper side in FIG. 2). A first protruding portion 13 is integrally formed inside the recessed portion 12 of the first housing 11 as an island. Side wall portions 14 are integrally formed with the first housing 11 and extend parallel to the first protruding portion 13 on both sides of the first protruding portion 13.

Here, the first protruding portion 13 and the side wall portions 14 protrude upward from the bottom surface of the recessed portion 12, and extend in the longitudinal direction of the first housing 11. A slender recessed groove portion 12*a* extending in the longitudinal direction of the first housing 11 is formed as a section of the recessed portion 12 on both ends of the first protruding portion 13.

Here, a groove-shaped first terminal accommodating inner cavity 15*a* is formed on both side surfaces of the first protruding portion 13. A groove-shaped first terminal accommodating outer cavity 15*b* is also formed on both inside surfaces of the side wall portions 14. The first terminal accommodating inner cavity 15*a* and first terminal accommodating outer cavity 15*b* are connected to and integrated with the bottom surface of the recessed groove portion 12*a*. When the first terminal accommodating inner cavity 15*a* and the first terminal accommodating outer cavity 15*b* are explained collectively, they will be referred to simply as the first terminal accommodating cavities 15.

In the present embodiment, first terminal accommodating cavities 15 are formed side by side in the longitudinal direction of the first housing 11 on both sides of the first housing 11 in the transverse direction. More specifically, a plurality are formed on both sides of the first protruding portion 13 at a predetermined pitch. The first terminals 61 accommodated inside each of these first terminal accommodating cavities 15 are also arranged on both sides of the first protruding portion 13 at the same pitch.

Because there are two types of first terminal 61 housed in each of the first terminal accommodating cavities 15, namely, a wide first terminal 61A and a narrow first terminal 61B, there are also two types of first terminal accommodating cavity 15, namely, a wide first terminal accommodating cavity 15A for accommodating a wide first terminal 61A and a narrow first terminal accommodating cavity 15B for accommodating a narrow first terminal 61B. The wide first terminal accommodating cavities 15A are formed on both ends in the longitudinal direction of each row running along both sides in the transverse direction of the first housing 11, and narrow first terminal accommodating cavities 15B are formed in each row between the wide first terminal accommodating cavities 15A on both ends. In the example shown in the drawings and explained here, there are four narrow first terminal accommodating cavities 15B formed on both sides of the first protruding portion 13, but there may be three or less on both sides or five or more on both sides.

Because the configuration of the wide first terminal accommodating cavities 15A and the narrow first terminal accommodating cavities 15B is identical except for the width dimension, they are sometimes referred to collectively in the following explanation as the first terminal accommodating cavities 15. Because the configuration of the wide first terminals 61A and the narrow first terminals 61B is identical except for the width dimension, they are sometimes referred to collectively in the following explanation as the first terminals 61.

Each first terminal 61 is an integrally formed component obtained by stamping and bending a conductive metal sheet, and includes a held portion, a tail portion 62 connected to the lower end of the held portion, an upper connecting portion 67 connected to the upper end of the held portion, a second contact portion 66 formed near the inside end of the upper connecting portion 67, a lower connecting portion 64 connected to the second contact portion 66, and a first contact portion 65 formed near the free end of the lower connecting portion 64.

The held portion extends vertically, that is, in the thickness direction of the first housing 11, and is inserted into and held by a first terminal accommodating outer cavity 15*b*. The tail portion 62 is curved and connected to the held portion, extends to the outside in the transverse direction, that is, in the width direction of the first housing 11, and is connected using, for example, solder to a connecting pad linked to a conductive trace in the first board.

A second contact portion 66 is formed on the inner end of the upper connecting portion 67 so as to bend downward and protrude inward in the transverse direction of the first housing 11. The lower connecting portion 64 has a U-shaped lateral profile and is connected to the second contact portion 66. A first contact portion 65 is formed near the free end of the lower connecting portion 64, that is, near the upper end to the inside, and is bent into a U-shape, and protrudes outward in the transverse direction of the first housing 11.

Each first terminal 61 is fitted into a first terminal accommodating cavity 15 from the mounting surface 11*b* (the lower end in FIG. 2), and the held portion is clamped on both sides by the side wall of the first terminal accommodating outer cavity 15*b* formed in the inside surfaces of the side wall portion 14 to secure the first housing 11. When the first terminal 61 is mounted in the first housing 11, the first contact portion 65 and the second contact portion 66 are positioned to the left and right of the recessed groove portion 12*a* and face each other.

Because each first terminal 61 is an integrally formed component obtained by machining a metal strip, it has elasticity. It is clear from the shape that the first contact portion 65 and the second contact portion 66 face each other and are elastically displaceable. In other words, when a second terminal 161 on the second connector 101 is inserted between the first contact portion 65 and the second contact portion 66, the gap between the first contact portion 65 and the second contact portion 66 is extended elastically.

All of the first terminals 61, that is, both the wide first terminals 61A and the narrow first terminals 61B have the same cross-sectional profile, that is, the same cross-sectional profile along the axis extending from the free end of the tail portion 62 to the free end of the first contact portion 65. Therefore, all of the first terminals 61 have an equal electrical length from the tail portion 62 to the contact portion with a second terminal 161.

First protruding end portions 21 serving as mating guide portions are arranged at both ends of the first housing 11 in the longitudinal direction. A mating recessed portion 22 is formed in a section of the recessed portion 12 of each first protruding end portion 21. Each mating recessed portion 22 is a recessed portion with a rectangular profile, and is connected to both ends of each recessed groove portion 12*a* in the longitudinal direction. When the first connector 1 and the second connector 101 have been mated, the mating recessed portions 22 receive the inserted second protruding end portions 122 of the second connector 101 described below.

The first protruding end portion 21 includes a side wall extending portion 21*c* extending from both longitudinal ends of the side wall portions 14 in the longitudinal direction of the first housing 11, and end wall portions 21*b* extending in the transverse direction of the first housing 11. In each first protruding end portion 21, the end wall portions 21*b* and the side wall extending portions 21*c* connected at both ends create a continuous side wall with a squared-off C-shaped profile and define three sides of a mating recessed portion 22 with a rectangular profile.

A first reinforcing metal fitting 51 is attached to the first protruding end portion 21. The first reinforcing metal fitting 51 is accommodated inside and held by the first metal fitting holding recessed portion 26 formed in the first protruding end portion 21. The first metal fitting holding recessed portion 26 has a squared-off C-shaped profile when viewed from the mating surface side. The upper surface 21*a* of the first protruding end portion 21 is open, and a slit-like space extends from the upper surface 21*a* downward in the thickness direction of the first housing 11.

The squared-off C-shaped side wall formed by the end wall portion 21*b* and the side wall extending portions 21*c* is divided by the first metal fitting holding recessed portion 26 into an inner wall portion 21*f* and outer wall portions 21*k*. The inner wall portion 21*f* has a squared-off C-shaped profile and is connected to both longitudinal ends of the side wall portion 14. Each outer wall portion 21*k* is divided into three, namely, into a central portion 21*g* and left and right corner portions 21*h* by the first arm portion accommodating opening 26*f* and the first fixed portion accommodating opening 26*e* in the first metal fitting holding recessed portion 26. The first fixed portion accommodating opening portion 26*e* opens into the outer surface of an end wall portion 21*b*, and the first arm portion accommodating opening 26*f* opens into the outer surface near the section where the side wall extending portion 21*c* connects to the end wall portion 21*b*. The outer wall surface of the central portion 21*g* is the outermost side wall in the longitudinal direction of the first housing 11.

A second fixed portion accommodating opening 26*g* is formed in the section of the inner wall portion 21*f* near the end wall portion 21*b* of the side wall extending portion 21*c*. The second fixed portion accommodating opening 26*g* is formed so as to pass through the bottom panel of the mating recessed portion 22.

An inner end protruding portion 25 is formed on the inner wall portion of each end wall portion 21*b* and extends towards the first protruding portion 13. The opposing flat surface 25*a* of the inner end protruding portion 25 facing the first protruding portion 13 is a flat surface functioning as a reference surface for positioning of the various components of the first connector 1 relative to the longitudinal direction of the first housing 11.

In the present embodiment, the first reinforcing metal fitting 51 is an integrally formed component obtained by stamping and bending a metal sheet, and includes a slender first main body portion 52 extending in the transverse direction of the first housing 11, a slender connecting arm portion 53 connected to both the left and the right end of the first main body portion 52, a side guide portion 55 connected to the leading end of the connecting arm portion 53, and a central guide portion 57 connected to the upper end of the first main body portion 52.

Figure 1B:
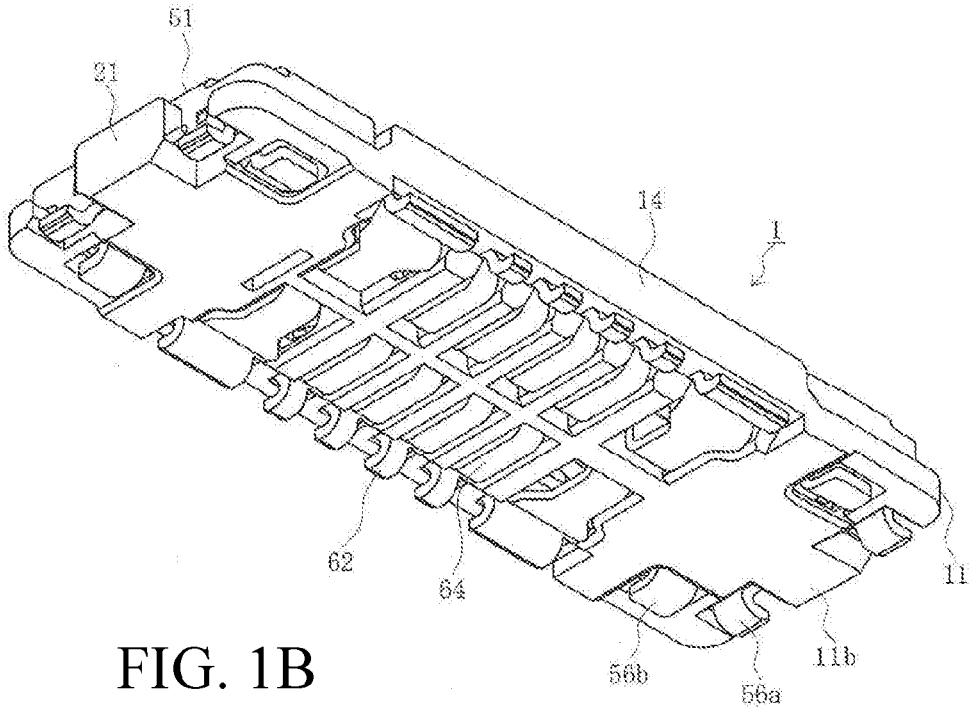
Figure 2:
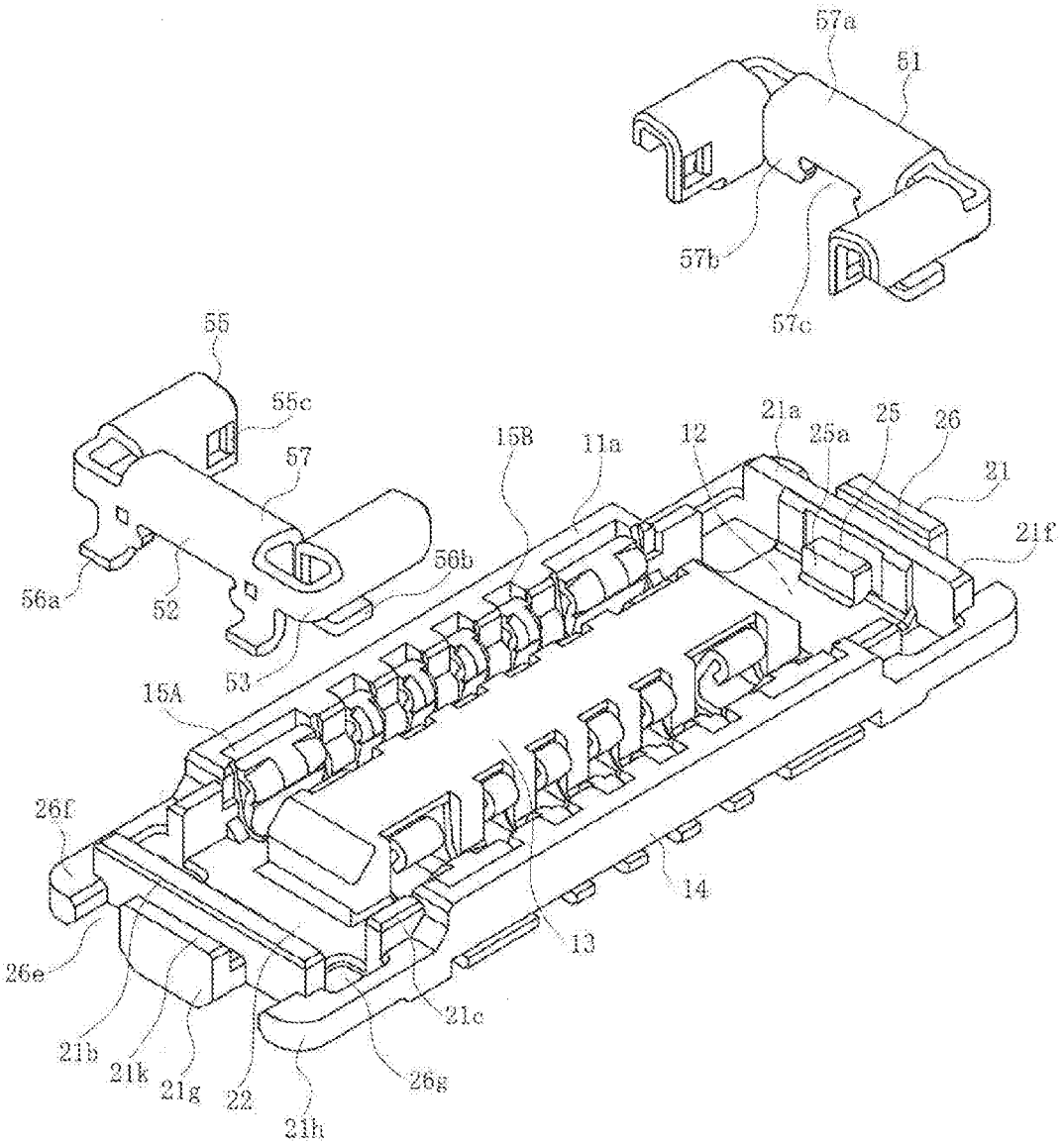
FIG. 2 is a partially exploded perspective view from above of the first connector in an embodiment of the present disclosure in which only the first reinforcing metal fitting has been removed.
Figure 3A:
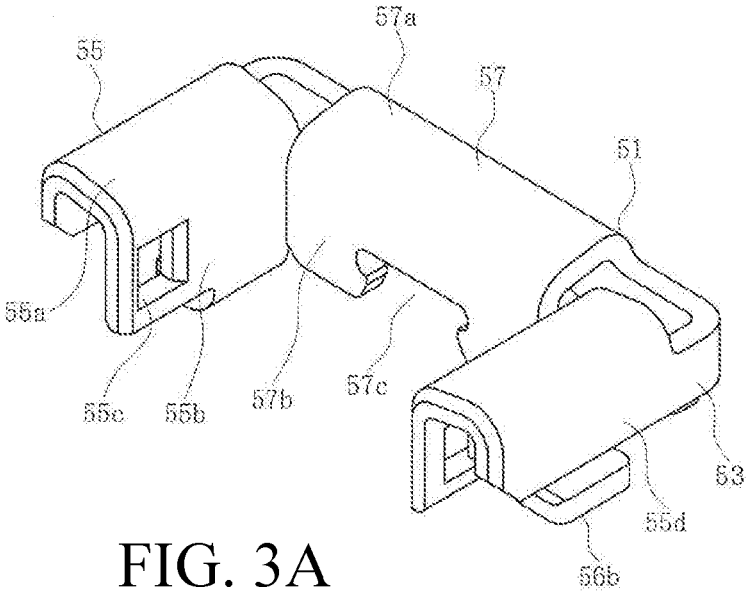
Figure 3B:
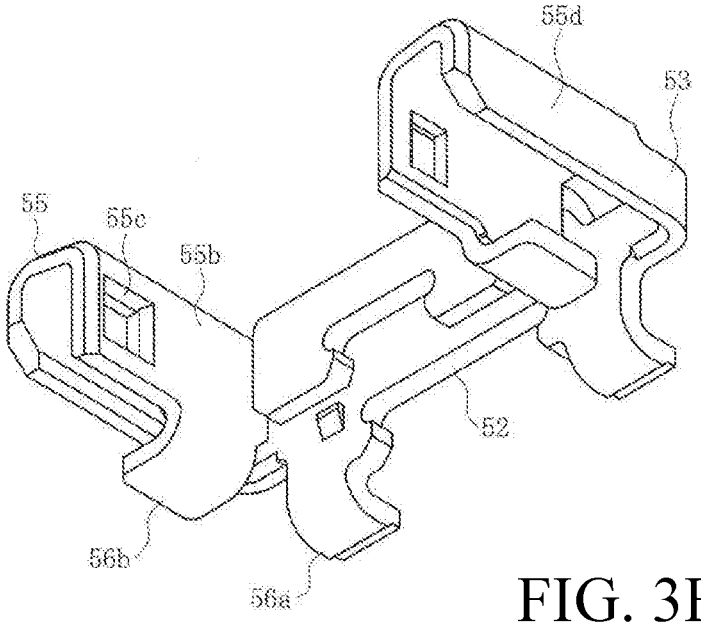
Figure 4A:
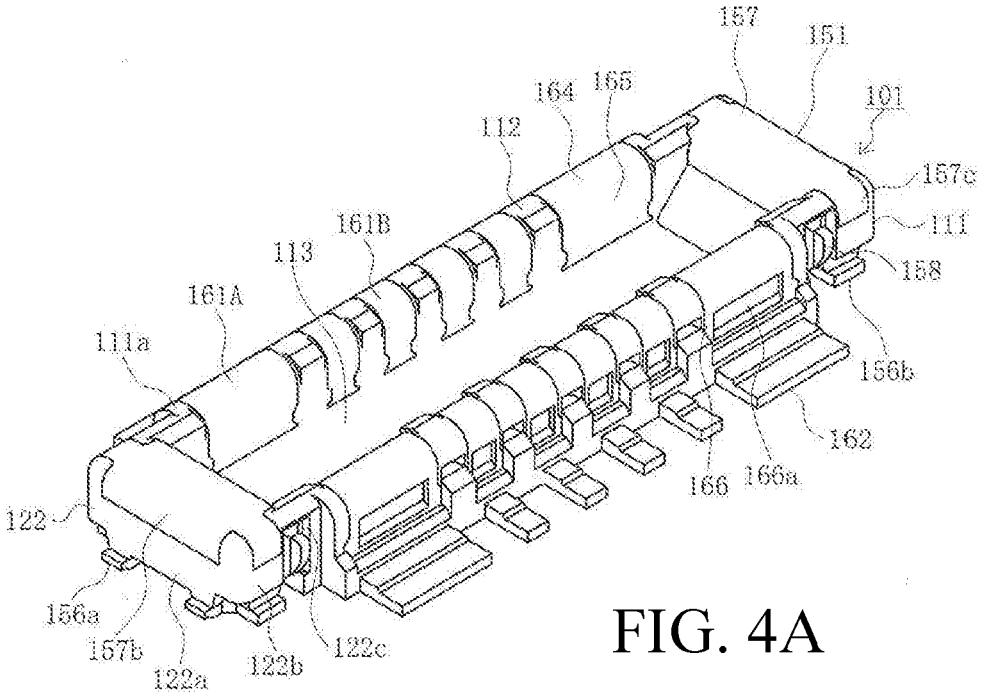
Figure 4B:
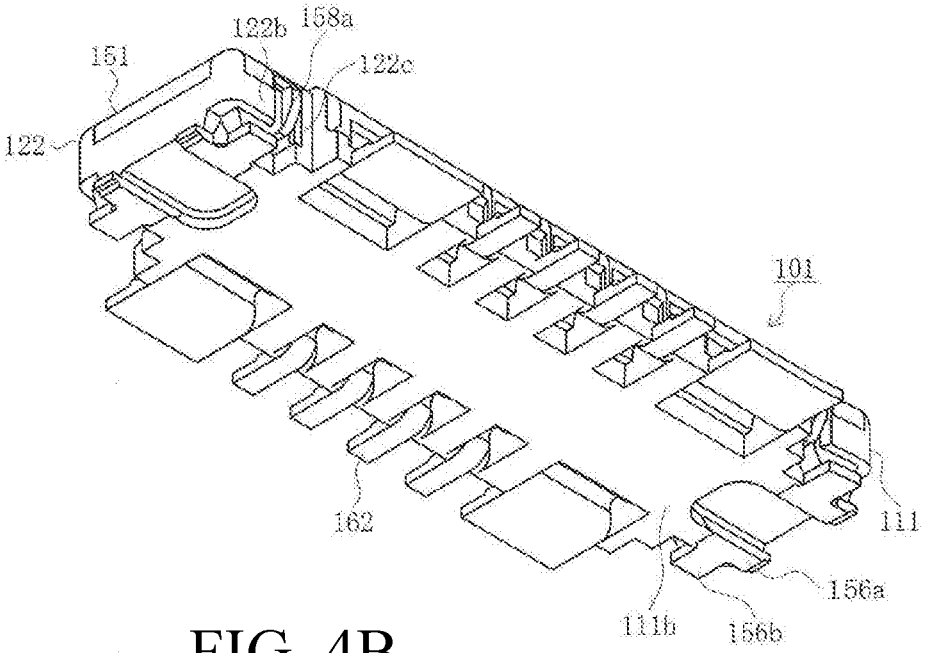

The first main body portion 52 is fixed to the central portion 21*g* of the outer wall portion 21*k*. The connecting arm portion 53 is bent so as to have a substantially L-shaped profile when viewed from above, that is, in plan view, and so as to be elastically displaceable in both the vertical direction and the horizontal direction. The connecting arm portion 53 is accommodated inside the first arm portion accommodating opening 26*f* when the first reinforcing metal fitting 51 is mounted in the first protruding end portions 21 as shown in FIGS. 1A and 1B.

The side guide portion 55 is an angular cylinder extending from the leading end of the connecting arm portion 53 in the longitudinal direction of the first housing 11, and includes an upper wall portion 55*a*, an inner wall portion 55*b*, and an outer wall portion 55*d*. The upper wall portion 55*a* is substantially parallel to the mating surface 11*a* of the first housing 11 and covers the side wall extending portion 21*c* from above when the first reinforcing metal fitting 51 is mounted on the first protruding end portions 21. The inner wall portion 55*b* is a flat panel extending downward from the inner end of the upper wall portion 55*a* and covers the inside surface of the mating recessed portion 22 when the first reinforcing metal fitting 51 is mounted on the first protruding end portions 21. The outer wall portion 55*d* is a flat panel extending downward from the outer end of the upper wall portion 55*a*, running parallel to the inner wall portion 55*b* and remaining flush with the connecting arm portion 53. It covers the outer surface of the side wall extending portion 21*c* when the first reinforcing fitting 51 is mounted on the first protruding end portions 21.

An engaging recessed portion 55*c* is formed in the front end portion of the inner wall portion 55*b* (the end opposite the first main body portion 52) to engage the opposing engaging portion. In the example shown in the drawing, the engaging recessed portion 55*c* is an opening that passes through the inner wall portion 55*b* in the thickness direction. However, when the first connector 1 and the second connector 101 are mated, it can engage the leading end portion 158*a* of the engaging protruding portion 158 on the second reinforcing metal fitting 151 on the second connector 101 described below. It also does not have to pass through the inner wall portion 55*b*. The opposing engaging portion does not have to be a recessed portion such as the engaging recessed portion 55*c*. It can be a protruding portion able to engage the leading end portion 158*a* of the engaging protruding portion 158. However, an engaging recessed portion 55*c* is used in the following explanation.

A first fixed portion 56*a* and a second fixed portion 56*b* extend from the lower end of the rear end portion of the connecting arm portion 53 (connected to the first main body portion 52) and the lower end of the rear end portion of the inner wall portion 55*b* (the end on the first main body portion 52 side) and are fixed to the surface of the first board. Therefore, when the first connector 1 is mounted on the surface of the first board, the rear end portion of the side guide portion 55 is secured and the front end portion can be elastically displaced in the vertical direction as a free, cantilevered spring member. Because there are two secured rear end portions, namely, a first fixed portion 56*a* and a second fixed portion 56*b*, it does not peel off the surface of the first board.

The length along the connecting arm portion 53 and the side guide portion 55 from the first fixed portion 56*a* and the second fixed portion 56*b* to the engaging recessed portion 55*c* positioned in the front end portion of the connecting arm portion 53 is great and functions as a long spring. In this way, the engaging recessed portion 55*c* can be elastically displaced across a wide range in the vertical direction.

When the first reinforcing metal fitting 51 is mounted on the first protruding end portion 21, the central guide portion 57 covers a portion of the upper surface of the inner wall portion 21*f* and the inner surface of the end wall portion 21*b*. The central guide portion 57 includes an upper covering portion 57*a* whose base end is connected to the upper end of the first main body portion 52 and whose leading end curves downward at an angle, and an inner covering portion 57*b* connected at the base end to the leading end of the upper covering portion 57*a* and extending downward at the leading end.

A protruding portion accommodating opening 57*c* for accommodating the inner end protruding portion 25 is formed in the central portion at the lower end of the inner covering portion 57*b*. In this way, the opposing flat portion 25*a* is exposed inside the mating recessed portion 22 even when the first reinforcing metal fitting 51 is mounted on the first protruding end portion 21. By mating the protruding portion accommodating opening 57*c* with the inner end protruding portion 25, the first reinforcing metal fitting 51 is positioned relative to the first protruding end portion 21.

The following is an explanation of the configuration of the second connector 101, with reference to FIGS. 4A, 4B, 5, 6A and 6B.

The second connector 101 has a second housing 111, which is the integrally molded second connector main body made of an insulating material such as a synthetic resin. As shown in the drawings, the second housing 111 has a rectangular thick panel-like shape. The second housing 111 includes an integrally formed slender recessed groove portion 113 extending in the longitudinal direction of the second housing 111 on the side mated with the first connector 1, that is, in the mating surface 111*a* side (the upper side in FIG. 5), and second protruding portions 112 serving as slender protruding portions, which define the outside of the recessed groove portion 113 and extend in the longitudinal direction of the second housing 111. The second protruding portions 112 extend along both sides of the recessed groove portion 113 and along both sides of the second housing 111.

Each second protruding portion 112 includes an opposing second terminal 161. The recessed groove portion 113 is closed by a bottom plate on the side mounted on the second board, that is, on the mounting surface 111*b* (the lower end in FIG. 5).

There are two types of second terminals 161, namely, wide second terminals 161A and narrow second terminals 161B. The wide second terminals 161A are formed on both ends in the longitudinal direction of each row running along both sides in the transverse direction of the second housing 111, and the narrow second terminals 161B are formed in each row between the wide second terminals 161A on both ends. In the example shown in the drawings and explained here, there are four narrow second terminals 161B formed on both sides of the second protruding portion 112, but there may be three or less on both sides or five or more on both sides.

Because the configuration of the wide second terminals 161A and the narrow second terminals 161B is identical except for the width dimension, they are sometimes referred to collectively in the following explanation as the second terminals 161.

Each second terminal 161 is an integrally formed conductive metal plate which has been stamped and bent, and has a held portion (not shown), a tail portion 162 connected to the bottom end of the held portion, a second contact portion 166 connected to the upper end of the held portion, a connecting portion 164 connected to the upper end of the second contact portion 166, and a first contact portion 165 connected to the inner end of the connecting portion 164. A second contact recessed portion 166*a* is formed in the surface of the second contact portion 166.

The main body portion (not shown) is held in and surrounded by the second housing 111. The tail portion 162 extends in the transverse direction of the main body portion, that is, the width direction of the second housing 111, and is connected using, for example solder to a connecting pad linked to a conductive trace on the second board. The conductive trace is typically a signal line.

The second terminals 161 are integrally molded with the second housing 111 using a molding method such as overmolding or insert molding. In other words, the second terminals 161 are set inside the second housing 111 and the mold cavity is filled with an insulating material. In this way, each second terminal 161 is integrally attached to the second housing 111 so that the main body is embedded in the second housing 111, but the surfaces of the first contact portion 165, the connecting portion 164, and the second contact portion 166 are exposed on the side surfaces of the second protruding portions 112 and the mating surface 111*a*.

All of the second terminals 161, that is, both the wide second terminals 161A and the narrow second terminals 161B have the same cross-sectional profile, that is, the same cross-sectional profile along the axis extending from the free end of the tail portion 162 to the free end of the first contact portion 165. Therefore, all of the second terminals 161 have an equal electrical length from the tail portion 162 to the contact portion with a first terminal 61.

A second protruding end portion 122 serving as a mating guide portion is provided on both ends of the second housing 111 in the longitudinal direction. The second protruding end portions 122 are thick components extending in the transverse direction of the second housing 111, and both ends are connected to each second protruding portion 112 in the longitudinal direction. When the first connector 1 and the second connector 101 are mated, the second protruding end portions 122 function as insertion protruding portions for insertion into the protruding end recessed portions 22 of the first protruding end portions 21 in the first connector 1.

The second reinforcing metal fitting 151 is mounted on the second protruding end portions 122. As in the case of the second terminals 161, the second reinforcing metal fitting 151 is integrated with the second housing 111 using a molding technique such as overmolding or insert molding. In other words, as in the case of the second terminals 161, the second reinforcing metal fitting 151 is set inside the second housing 111 and the mold cavity is filled with an insulating material.

Figure 5:
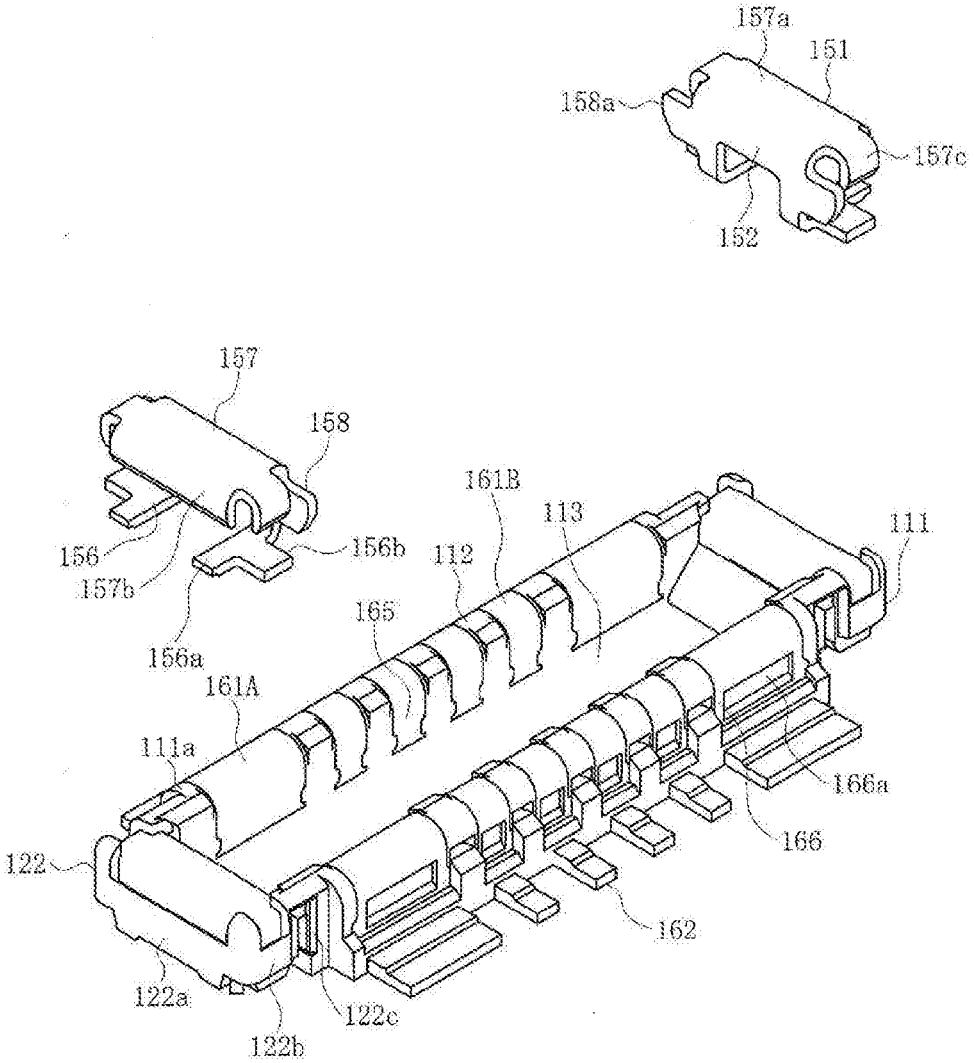
FIG. 5 is a partially exploded perspective view from above of the second connector in an embodiment of the present disclosure in which only the second reinforcing metal fitting has been removed.
Figure 6A:
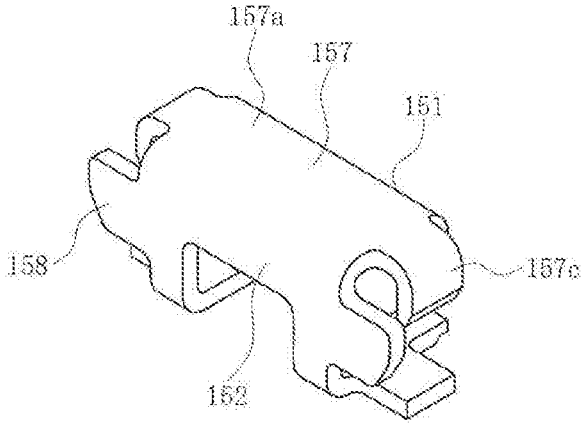
Figure 6B:
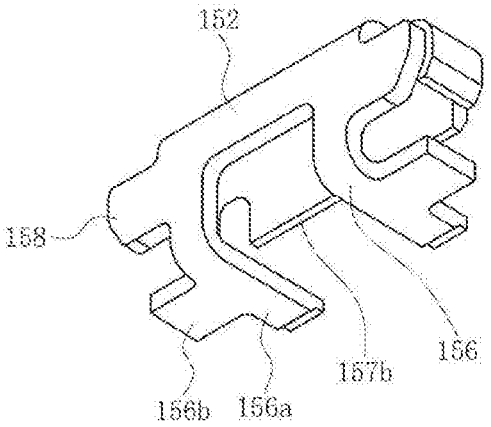

In FIG. 5, it is unclear from the depiction whether the second reinforcing metal fitting 151 and the second housing 111 are separate components that are assembled together. However, when overmolding or insert molding is performed on the second housing 111 of the present embodiment, at least a portion of the area surrounding the second reinforcing metal fitting 151 is covered and integrated with an insulating resin.

The second reinforcing metal fitting 151 in the present embodiment is an integrally formed conductive metal plate which has been stamped and bent, and includes a slender second main body portion 152 extending in the transverse direction of the second housing 111, a central covering portion 157 connected to the upper end of the second main body portion 152, an engaging protruding portion 158 extending outward from both the left and right ends of the second main body portion 152, and a fixed portion 156 extending from the bottom end of the section in which the engaging protruding portion 158 and the second main body portion 152 connect.

The second main body portion 152 is exposed on the inner wall surface of the end wall portion 122*a* of the second protruding end portion 122. The central covering portion 157 includes an upper wall portion 157*a* covering the upper surface of the end wall portion 122*a*, an outer wall portion 157*b* extending downward from the outer end of the upper wall portion 157*a* and exposed on the outer wall surface of the end wall portion 122*a*, and a side wall portion 157*c* extending downward from both the left and right ends of the upper wall portion 157*a* and exposed on the outer wall surface of the side wall portion 122*b* of the second protruding end portion 122. The fixed portion 156 is bent to form an L-shape when viewed from the side, and the leading end section is parallel to the mating surface 111*a* of the second housing 111. The leading end section branches into a first fixed portion 156*a* extending towards the outer wall surface of the end wall portion 122*a*, and a second fixed portion 156*b* extending towards the outer wall surface of the side wall portion 122*b*. The first fixed portion 156*a* and the second fixed portion 156*b* are secured to the second board using a connecting means such as solder.

At least the leading end portion 158*a* of the engaging protruding portion 158 extends outward from the outer wall surface of the side wall portion 122*b*. At least a portion of the outer wall of the engaging protruding portion 158 excluding the section protruding outward from the outer wall surface of the side wall portion 122*b* is covered by the resin forming the side wall portion 122*b*. More specifically, a portion on at least the mating surface 111*a* side of the outer surface of the engaging protruding portion 158 is covered with the insulating material forming the side wall portion 122*b*. Note that at least a portion of the outer wall surface of the side wall portion 122*b* surrounding the engaging protruding portion 158 includes a recessed portion 122*c* extending inward from the surrounding surface. In this way, the protruding dimension from the outer wall surface of the side wall portion 122*b* to the leading end portion 158*a* can be maintained even when insulating material flows into the periphery of the engaging protruding portion 158 and creates burrs.

Therefore, when the first connector 1 and second connector 101 are unmated and force is applied from the engaging protruding portion 55*c* of the first reinforcing metal fitting 51 engaging the leading end portion 158*a* towards the mating surface 111*a*, the force is partially supported by the side wall portion 122*b* and the engaging protruding portion 158 does not become deformed in the direction of the mating surface 111*a*.

The following is an explanation of the operations performed to mate a first connector 1 and a second connector 101 with these configurations, with reference to FIGS. 7, 8A, 8B, 9A, and 9B.

In the present embodiment, the first terminals 61 and the second terminals 161 may be connected to signal lines or power lines.

For example, all of the first terminals 61 and all of the second terminals 161 can be connected to power lines as a parallel circuit. Because the wide first terminals 61A and the narrow first terminals 61B have the same cross-sectional profile and electrical length, only differing in terms of the width dimension, and because the wide second terminals 161A and the narrow second terminals 161B also have the same cross-sectional profile and electrical length, only differing in terms of the width dimension, the resistance value depends only on the width dimension and the shunt is easy to calculate. The amount of current is greater but, because the wide first terminals 61A and second terminals 161 that generate more heat are arranged at both ends in the longitudinal direction of the first housing 11 and the second housing 111, the heat is easily dissipated and the first connector 1 and the second connector 101 do not become hot.

Also, for example, the wide first terminals 61A and second terminals 161A can be connected to power lines, and the narrow first terminals 61B and second terminals 161B are connected to signal lines. Here, for example, the power lines from batteries installed in an electronic device can be connected to the wide first terminals 61A and second terminals 161A, and signal lines carrying signals such as the identification number, remaining power level, and temperature of the batteries can be connected to the narrow first terminals 61B and second terminals 161B. Here, because the wide first terminals 61A and second terminals 161A connected to the power lines are on both ends in the longitudinal direction of the first housing 11 and the second housing 111, the heat is easily dissipated and the first connector 1 and the second connector 101 do not become hot.

Here, the first connector 1 is surface mounted on the first board by soldering the tail portions 62 of the first terminals 61 to connecting pads lined to conductive traces on the first board (not shown) and by soldering the first fixed portion 56*a* and the second fixed portion 56*b* of the first reinforcing metal fitting 51 to connecting pads linked to conductive traces on the first board. The conductive traces linked to connecting pads to which the tail portions 62 of the narrow first terminals 61B are connected are signal lines, and the conductive traces linked to connecting pads to which the tail portions 62 of the wide first terminals 61A are soldered are power lines. The connecting pads connected to the tail portions 62 are separate from each other. As a result, each of the four wide first terminals 61A in the first connector 1 can be connected to four power lines.

Similarly, the second connector 101 is surface mounted on the second board (not shown) by connecting the tail portions 162 of the second terminals 161 using, for example, solder to the connecting pads linked to the conductive traces of the second board, and by connecting the first fixed portion 156*a* and the second fixed portion 156*b* of the second reinforcing metal fitting 151 to conductive traces on the second board. The conductive traces linked to the connecting pads that are connected to the tail portions 162 of the narrow second terminals 161B are signal lines, and the conductive traces linked to the connecting pads that are connected to the tail portions 162 of the wide second terminals 161A are power lines. The connecting pads connected to the tail portions 162 are separate from each other. As a result, each of the four wide second terminals 161A in the second connector 101 can be connected to four power lines.

First, the operator manipulates the mating surface 11*a* of the first housing 11 of the first connector 1 so that it is opposite the mating surface 111*a* of the second housing 111 of the second connector 101, aligns the positions of the second protruding portions 112 of the second connector 101 with the positions of the corresponding recessed groove portions 12*a* in the first connector 1, and aligns the positions of the second protruding end portions 122 of the second connector 101 with the positions of the corresponding protruding end recessed portions 22 of the first connector 1 to complete the positioning of the first connector 1 and the second connector 101.

The first connector 1 and/or second connector 101 is moved closer to the other connector, that is, in the mating direction, and the second protruding portions 112 and the second protruding end portions 122 of the second connector 101 are inserted into the recessed groove portions 12*a* and mating recessed portions 22 of the first connector 1. In this way, as shown in FIG. 8, an electrical connection is established between the first terminals 61 and the second terminals 161 when the first connector 1 and the second connector 101 have been mated.

More specifically, each second terminal 161 on the second connector 101 is inserted between the first contact portion 65 and second contact portion 66 of a first terminal 61, the first contact portion 65 of the first terminal 61 and the first contact portion 165 of the second terminal 161 come into contact, and the second contact portion 66 of the first terminal 61 and the second contact portion 166 of the second terminal 161 come into contact. As a result, the conductive traces linked to the connecting pads of the first board connected to the tail portions 62 of the first terminals 61 and the conductive traces linked to the connecting pads of the second board connected to the tail portions 162 of the second terminals 161 establish an electrical connection.

The spring action of each first terminal 61 causes the first contact portion 65 and the second contact portion 66 to clamp a second terminal 161 on both sides. The second contact portion 66 of the first terminal 61 engages the second contact recessed portion 166*a* formed on the surface of the second contact portion 166 of the second terminal 161. Because each second terminal 161 is securely held by a first terminal 61, the second terminals 161 do not become detached from the first terminals 61, and the first connector 1 and the second connector 101 remain mated.

Because the first connector 1 and the second connector 101 are mounted, respectively, on a wide-area first board and second board, the operator cannot see the mating surface 11*a* of the first connector 1 and the mating surface 111*a* of the second connector 101, and must perform the mating operation by groping about. Because the connectors cannot be properly aligned simply by groping about, the first connector 1 and the second connector 101 are sometimes misaligned. When the first connector 1 and the second connector 101 are misaligned, the mating surface 111*a* of the second connector 101 may be tilted relative to the mating surface 11*a* of the first connector 1.

Figure 7:
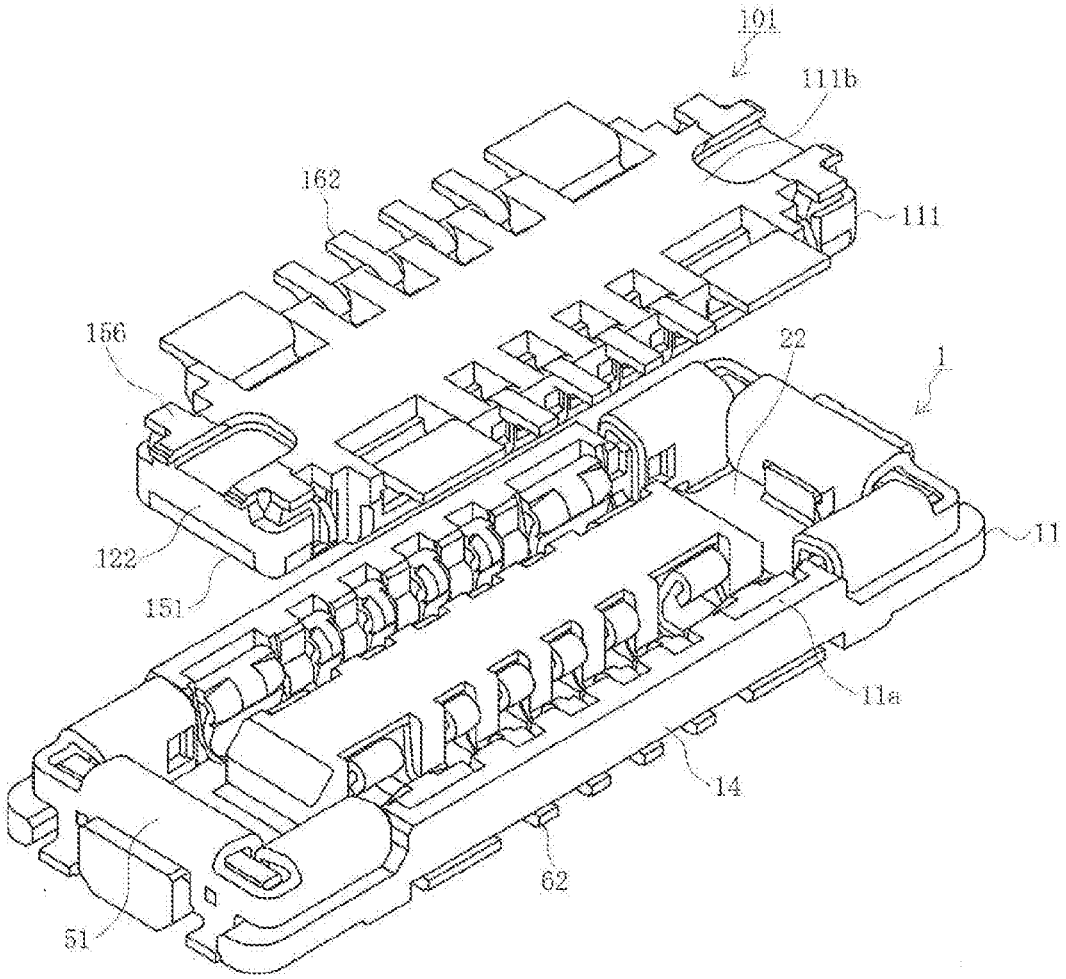
FIG. 7 is a perspective view showing the positional relationship between the first connector and the second connector in an embodiment of the present disclosure during the connector mating operation.
Figure 8A:
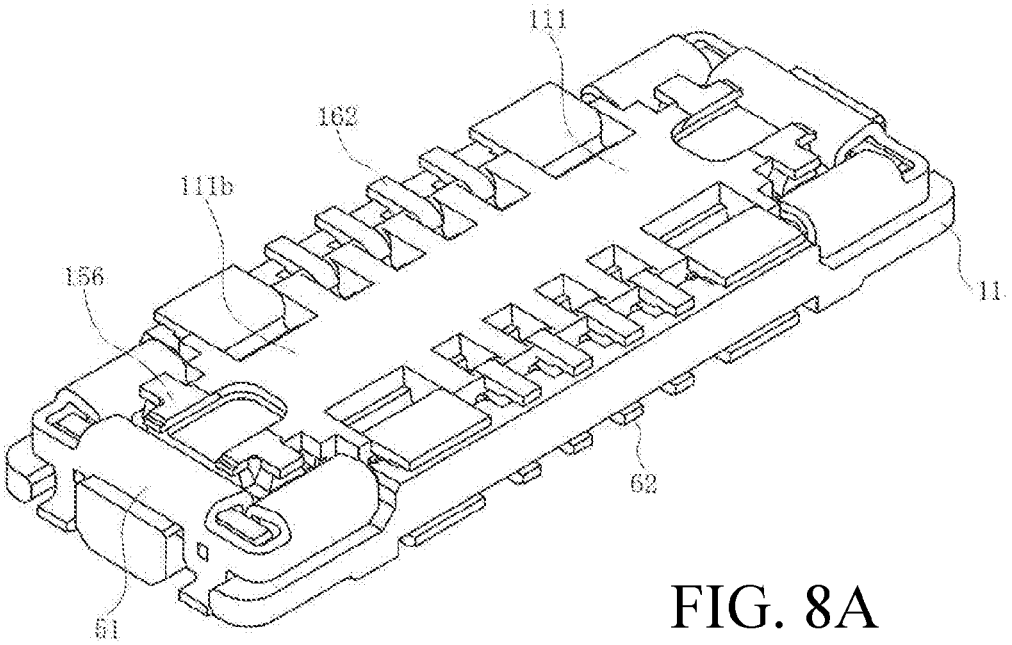
Figure 8B:
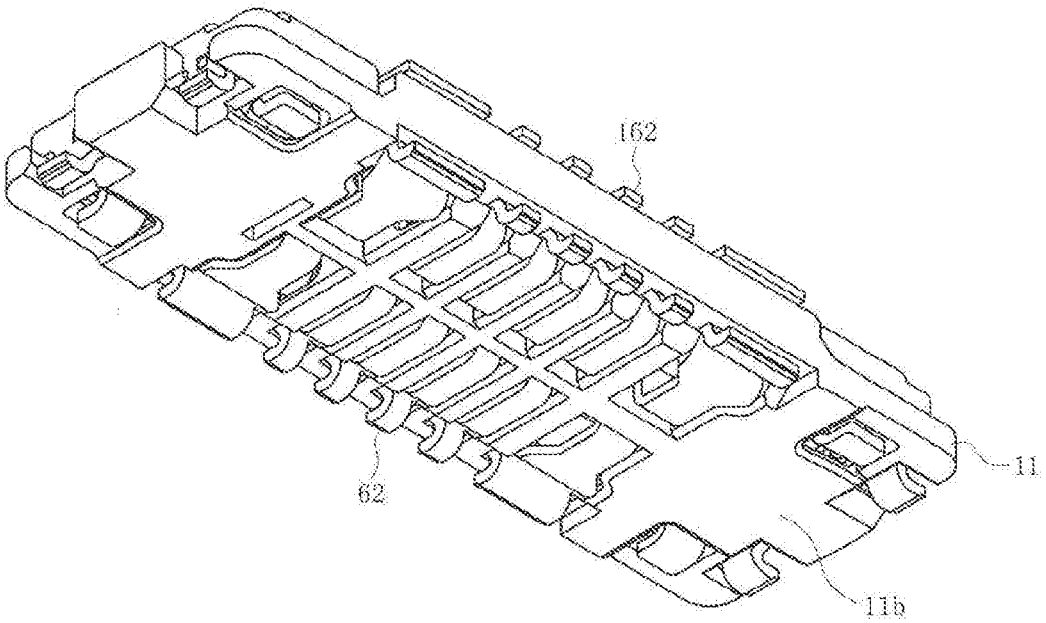

In this situation, when the operator moves the first connector 1 and/or the second connector 101 towards the other connector in the mating direction, one of the second protruding end portions 122 of the second connector 101 comes into contact with one of the first protruding end portions 21 of the first connector 1, and the first protruding end portion 21 is strongly pressed against the second protruding end portion 122 in the mating direction, that is, downward in FIG. 7.

However, in the present embodiment, a first reinforcing metal fitting 51 is mounted on the first protruding end portions 21 and each first protruding end portion 21 is covered by the central guide portion 57 and the side guide portion 55 of the first reinforcing metal fitting 51. Thus, the pressure is transmitted to the first board via the first fixed portion 56*a* and the second fixed portion 56*b* of the first reinforcing metal fitting 51 even when strongly pressed against by the second protruding end portion 122. Hardly any of the pressure is transmitted to the first protruding end portion 21. As a result, the first protruding end portion 21 is not broken or damaged.

Also, a second reinforcing metal fitting 151 is mounted on the second protruding end portions 122 and each second protruding end portion 122 is covered by the central covering portion 157 and the side wall covering portion 157*c* of the second reinforcing metal fitting 151. Thus, the pressure is transmitted to the second board via the first fixed portion 156*a* and the second fixed portion 156*b* of the second reinforcing metal fitting 161 even when strongly pressed against by the first protruding end portion 21. Hardly any of the pressure is transmitted to the second protruding end portion 122. As a result, the second protruding end portion 122 is not broken or damaged.

When the first connector 1 and the second connector 101 have been mated, an electrical connection is established between the first terminals 61 and the second terminals 161, and the first reinforcing metal fitting 51 on the first connector 1 is engaged with the second reinforcing metal fitting 151 on the second connector 101. In this way, an electrical connection is established between the first reinforcing metal fitting 51 of the first connector 1 and the second reinforcing metal fitting 151 of the second connector 101 and a power line connection can be maintained.

Figure 9A:
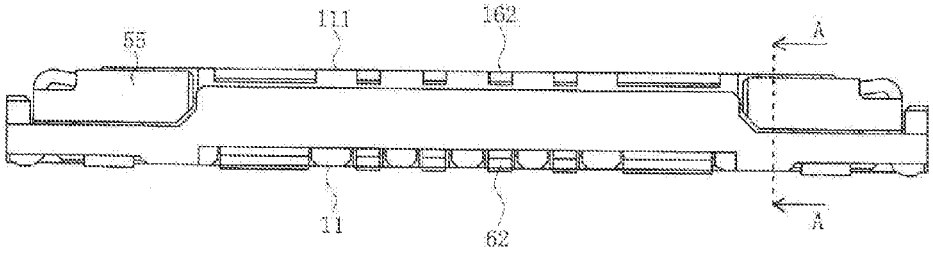
Figure 9B:
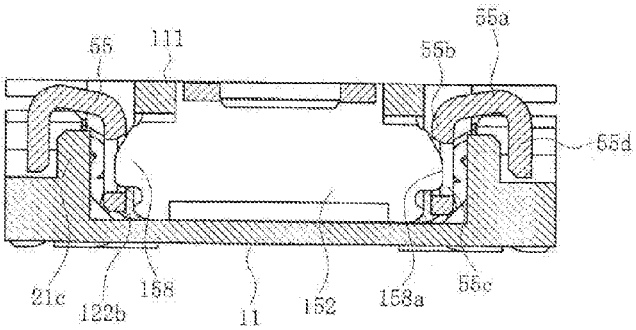
Figure 10A:
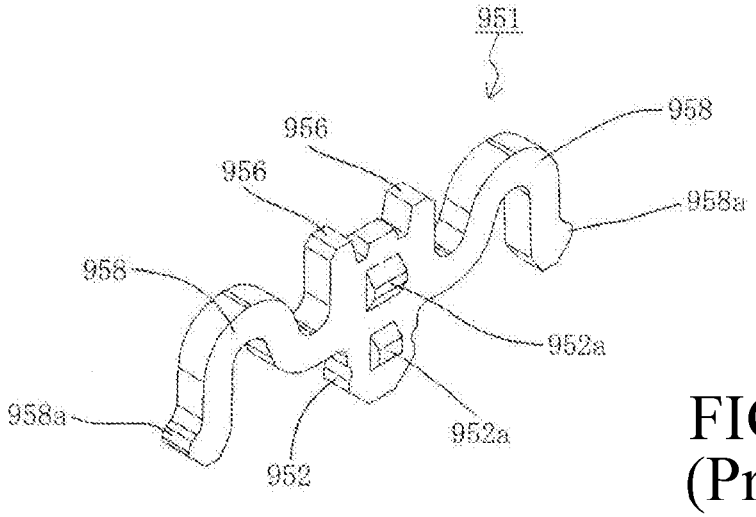
FIG. 10A (Prior Art)
Figure 10B:
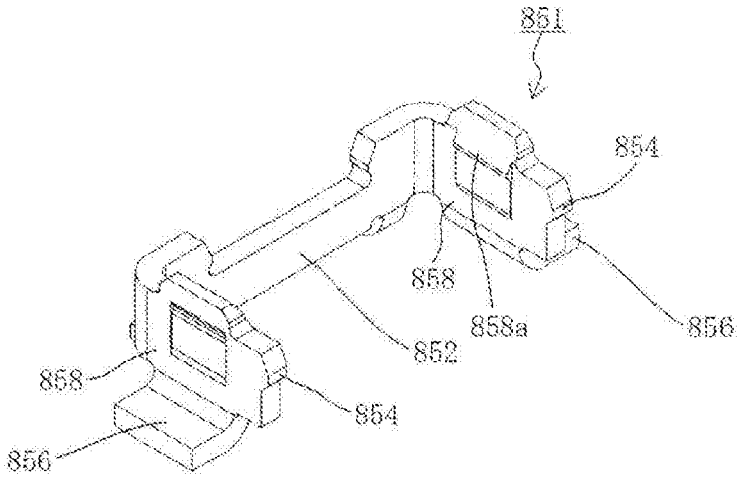
FIG. 10B (Prior Art)

More specifically, as shown in FIG. 9B, the second reinforcing metal fitting 151 is inserted into the first reinforcing metal fitting 51, and the leading end portions 158*a* of the left and right engaging protruding portions 158 of the second reinforcing metal fitting 151 are inserted into and engaged with the engaging recessed portions 55*c* of the left and right side guide portions 55 of the first reinforcing metal fitting 51. Note that the distance between the inner surfaces of the inner wall portions 55*b* of the left and right side guide portions 55 is shorter than the distance between the leading end portions 158*a* of the left and right engaging protruding portions 158. When the second reinforcing metal fitting 151 is inserted into the first reinforcing metal fitting 51, the distance between the inner side surfaces of the inner wall portions 55*b* of the left and right side guide portions 55 is increased by the left and right engaging protruding portions 158. However, as shown in FIG. 9B, when the leading end portions 158*a* of the left and right engaging protruding portions 158 are inserted into the engaging recessed portions 55*c*, the original distance is restored by the spring action of the first reinforcing metal fitting 51. In this way, the engaging recessed portions 55*c* of the side guide portions 55 and the leading end portions 158*a* of the engaging protruding portions 158 remain reliably engaged and, as a result, the first connector 1 and the second connector 101 are reliably locked.

Here, the engaging recessed portion 55*c* positioned at the front end portion of the connecting arm portion 53 has the spring action of a long spring and can be elastically displaced to a significant degree. Therefore, even when the first reinforcing metal fitting 51 and the second reinforcing metal fitting 151 are somewhat displaced by vibrations and impacts occurring when, for example, the electronic device including the first board and the second board is dropped, the engaging recessed portion 55*c* remains engaged despite the displacement of the leading end portion 158*a* of the engaging protruding portion 158. As a result, the first reinforcing metal fitting 51 and the second reinforcing metal fitting 151 remain reliably engaged, and the first connector 1 and the second connector 101 remain reliably locked.

Also, in order to unmate the first connector 1 and the second connector 101, the first connector 1 and/or second connector 101 is moved away from the other connector, that is, moved in the unmating direction. At this time, force in the detachment direction from the second housing 111 (downward force in FIG. 9B) is applied to the engaging protruding portion 158 whose leading end portion 158*a* is engaging the engaging recessed portion 55*c*. However, a portion of the engaging protruding portion 158 including at least the leading end portion 158*a* protrudes outward from the outer wall surface of the side wall portion 122*b*. Also, the area surrounding the engaging protruding portion 158 is covered with the insulating material forming the side wall portion 122*b*. More specifically, at least a portion of the mating surface 111*a* at least surrounding the engaging protruding portion 158 is covered with the insulating material forming the side wall portion 122*b*. This prevents displacement of the engaging protruding portion 158 in the detachment direction from the second housing 111, and keeps the engaging protruding portion 158 from becoming turned up.

In the present embodiment, the second connector 101 includes a second housing 111, second terminals 161 mounted in the second housing 111, and a second reinforcing metal fitting 151 mounted in the second housing 111. The second housing 111 includes second protruding end portions 122 formed at both ends in the longitudinal direction. The second protruding end portions 122 are mated with the first protruding end portions 21 formed on both ends of the first housing 11 of the first connector 1 in the longitudinal direction. The second reinforcing metal fitting 151 includes an engaging protruding portion 158 whose leading end portion 158*a* engages an engaging recessed portion 55*c* on the first reinforcing metal fitting 51 mounted on the first housing 11. At least a portion of the engaging protruding portion 158 including the leading end portion 158*a* protrudes from the wall surface of the second protruding end portion 122.

In this way, the second reinforcing metal fitting 151 is not deformed during the mating and unmating operations, and reliability can be maintained.

At least a portion of the mating surface 111*a* of the second housing 111 at least surrounding the engaging protruding portion 158 is coated with the insulating resin forming the second protruding end portion 122. Therefore, the engaging protruding portion 158 is kept from becoming displaced in the detachment direction from the second housing 111 and the engaging protruding portion 158 does not become turned up.

Also, a recessed portion 122*c* is formed in at least a portion of the wall surface of the second protruding end portion 122 surrounding the engaging protruding portion 158. In this way, the protruding dimension from the outer wall surface of the side wall portion 122*b* to the leading end portion 158*a* can be maintained even when insulating material flows into the periphery of the engaging protruding portion 158.

The second housing 111 is integrally formed by covering at least a portion of the periphery of the second reinforcing metal fitting 151 with an insulating material. In this way, the second housing 111 and the second reinforcing metal fitting 151 can be bonded securely.

Also, the wall surface of the second protruding end portion 122 is the outer wall of the side wall portion 122*b* of the second protruding end portion 122, the first protruding end portion 21 includes a mating recessed portion 22 for receiving the inserted second protruding end portion 122, the first reinforcing metal fitting 51 includes an inner wall portion 55*b* covering the inner surface of the mating recessed portion 22, and the engaging recessed portion 55*c* is formed in the inner wall portion 55*b*. Therefore, the first reinforcing metal fitting 51 and the second reinforcing metal fitting 151 remain reliably engaged, and the first connector 1 and the second connector 101 do not become disengaged.

The present disclosure is not limited to the embodiments described above. Many modifications and variations are possible without departing from the spirit and scope of the present disclosure.

The present disclosure can be applied to a connector.

The invention claimed is:

1. A connector, the connector comprising:

a connector main body, the connector main body including mating guide portions formed at both ends longitudinally, the mating guide portions configured to mate with mating guide portions of another connector, the connector main body being formed of an insulating resin material;

terminals mounted in the connector main body; and a reinforcing metal fitting molded into the connector main body such that the reinforcing metal fitting is not removable from the connector main body, the reinforcing metal fitting including an engaging protruding portion whose leading end portion is configured to engage with an engaging portion on the other connector, wherein a first portion of the reinforcing metal fitting is covered by the insulating resin material, and wherein a second portion of the reinforcing metal fitting, which second portion includes at least the leading end portion of the engaging protruding portion, is not covered by the insulating resin material, and wherein the second portion protrudes from a wall surface of one of the mating guide portions.

2. The connector according to claim 1, wherein at least a portion of a mating surface of the connector main body on the periphery of the engaging protruding portion is covered by the insulating resin material forming the mating guide portion.

3. The connector according to claim 1, wherein a recessed portion is formed in at least a portion of the wall surface on the periphery of the engaging protruding portion.

4. A reinforcing metal fitting for use on a connector, the reinforcing metal fitting comprising:

a main body portion having first and second opposite ends;

a first L-shaped connecting arm portion, the first L-shaped connecting arm portion having a first rear end portion and a first forward end portion, wherein the first forward end portion extends generally perpendicularly forwardly from the first rear end portion, the first rear end portion being connected to the first end of the main body portion;

a second L-shaped connecting arm portion, the second L-shaped connecting arm portion having a second rear end portion and a second forward end portion, wherein the second forward end portion extends generally perpendicularly forwardly from the second rear end portion, the second rear end portion being connected to the second end of the main body portion, whereby inner surfaces of the first and second forward end portions face each other;

a first J-shaped side guide portion, the first J-shaped side guide portion having a first outer wall portion, a first inner wall portion and a first upper wall portion, the first outer wall portion extending forwardly from a forward end of the first forward end portion, the first upper wall portion extending inwardly from an upper surface of the first outer wall portion, the first inner wall portion extending downwardly from the first upper wall portion such that a lower surface of the first inner wall portion is positioned lower than a lower surface of the first outer wall portion, the first inner wall portion defining a first engaging recessed portion therein proximate to a forward end of the first inner wall portion; and a second J-shaped side guide portion, the second J-shaped side guide portion having a second outer wall portion, a second inner wall portion and a second upper wall portion, the second outer wall portion extending forwardly from a forward end of the second forward end portion, the second upper wall portion extending inwardly from an upper surface of the second outer wall portion, the second inner wall portion extending downwardly from the second upper wall portion such that a lower surface of the second inner wall portion is positioned lower than a lower surface of the second outer wall portion, the second inner wall portion defining a second engaging recessed portion therein proximate to a forward end of the second inner wall portion.

5. The reinforcing metal fitting as defined in claim 4, wherein each of the first and second engaging recessed portions are openings which pass through the first and second inner wall portions, respectively, in a thickness direction of the first and second inner wall portions.

6. The reinforcing metal fitting as defined in claim 4, wherein each of the first and second engaging recessed portions face each other and are in general alignment with each other.

7. The reinforcing metal fitting as defined in claim 4, further comprising a fixed portion which extends downwardly from a lower end of each of the first and second inner wall portions, wherein the fixed portion is configured to be fixed to a circuit board.

8. The reinforcing metal fitting as defined in claim 7, wherein the fixed portion is generally L-shaped and has first and second portions, the first portion of the fixed portion extends downwardly from the lower end of each of the first and second inner wall portions, the second portion of the fixed portion extends outwardly from the first portion of the fixed portion, wherein a lower surface of the second portion of the fixed portion is configured to be fixed to the circuit board.

9. The reinforcing metal fitting as defined in claim 4, further comprising a fixed portion which extends downwardly from a lower end of each of the first and second rear end portions, wherein the fixed portion is configured to be fixed to a circuit board.

10. The reinforcing metal fitting as defined in claim 9, wherein the fixed portion is generally L-shaped and has first and second portions, the first portion of the fixed portion extends downwardly from the lower end of each of the first and second rear end portions, the second portion of the fixed portion extends rearwardly from the first portion of the fixed portion, wherein a lower surface of the second portion of the fixed portion is configured to be fixed to the circuit board.

11. The reinforcing metal fitting as defined in claim 4, further comprising a central guide portion which is generally L-shaped, the central guide portion having an upper covering portion and an inner covering portion, the upper covering portion connected to an upper end of the main body portion and extending forwardly from the main body portion, the inner covering portion extending downwardly from the upper covering portion such that a rear surface of the inner covering portion is spaced from a forward surface of the main body portion.

12. The reinforcing metal fitting as defined in claim 11, wherein a first outer end of the inner covering portion faces, and is positioned proximate to, an inner surface of the first inner wall portion, and wherein a second outer end of the inner covering portion faces, and is positioned proximate to, an inner surface of the second inner wall portion.

13. The reinforcing metal fitting as defined in claim 11, wherein a lower end of the inner covering portion defines an opening which is configured to accommodate a protruding portion of the connector.

14. A connector, the connector comprising:

a connector main body;

terminals mounted in the connector main body; and a reinforcing metal fitting mounted to the connector main body, wherein the reinforcing metal fitting comprises:

a main body portion having first and second opposite ends;

a first L-shaped connecting arm portion, the first L-shaped connecting arm portion having a first rear end portion and a first forward end portion, wherein the first forward end portion extends generally perpendicularly forwardly from the first rear end portion, the first rear end portion being connected to the first end of the main body portion;

a second L-shaped connecting arm portion, the second L-shaped connecting arm portion having a second rear end portion and a second forward end portion, wherein the second forward end portion extends generally perpendicularly forwardly from the second rear end portion, the second rear end portion being connected to the second end of the main body portion, whereby inner surfaces of the first and second forward end portions face each other;

a first J-shaped side guide portion, the first J-shaped side guide portion having a first outer wall portion, a first inner wall portion and a first upper wall portion, the first outer wall portion extending forwardly from a forward end of the first forward end portion, the first upper wall portion extending inwardly from an upper surface of the first outer wall portion, the first inner wall portion extending downwardly from the first upper wall portion such that a lower surface of the first inner wall portion is positioned lower than a lower surface of the first outer wall portion, the first inner wall portion defining a first engaging recessed portion therein proximate to a forward end of the first inner wall portion; and a second J-shaped side guide portion, the second J-shaped side guide portion having a second outer wall portion, a second inner wall portion and a second upper wall portion, the second outer wall portion extending forwardly from a forward end of the second forward end portion, the second upper wall portion extending inwardly from an upper surface of the second outer wall portion, the second inner wall portion extending downwardly from the second upper wall portion such that a lower surface of the second inner wall portion is positioned lower than a lower surface of the second outer wall portion, the second inner wall portion defining a second engaging recessed portion therein proximate to a forward end of the second inner wall portion.

15. The connector as defined in claim 14, wherein each of the first and second engaging recessed portions are openings which pass through the first and second inner wall portions, respectively, in a thickness direction of the first and second inner wall portions.

16. The connector as defined in claim 14, wherein each of the first and second engaging recessed portions face each other and are in general alignment with each other.

17. The connector as defined in claim 14, further comprising a fixed portion which extends downwardly from a lower end of each of the first and second inner wall portions, wherein the fixed portion is configured to be fixed to a circuit board.

18. The connector as defined in claim 17, wherein the fixed portion is generally L-shaped and has first and second portions, the first portion of the fixed portion extends downwardly from the lower end of each of the first and second inner wall portions, the second portion of the fixed portion extends outwardly from the first portion of the fixed portion, wherein a lower surface of the second portion of the fixed portion is configured to be fixed to the circuit board.

19. The connector as defined in claim 14, further comprising a fixed portion which extends downwardly from a lower end of each of the first and second rear end portions, wherein the fixed portion is configured to be fixed to a circuit board.

20. The connector as defined in claim 19, wherein the fixed portion is generally L-shaped and has first and second portions, the first portion of the fixed portion extends downwardly from the lower end of each of the first and second rear end portions, the second portion of the fixed portion extends rearwardly from the first portion of the fixed portion, wherein a lower surface of the second portion of the fixed portion is configured to be fixed to the circuit board.

21. The connector as defined in claim 14, further comprising a central guide portion which is generally L-shaped, the central guide portion having an upper covering portion and an inner covering portion, the upper covering portion connected to an upper end of the main body portion and extending forwardly from the main body portion, the inner covering portion extending downwardly from the upper covering portion such that a rear surface of the inner covering portion is spaced from a forward surface of the main body portion.

22. The connector as defined in claim 21, wherein a first outer end of the inner covering portion faces, and is positioned proximate to, an inner surface of the first inner wall portion, and wherein a second outer end of the inner covering portion faces, and is positioned proximate to, an inner surface of the second inner wall portion.

23. The connector as defined in claim 21, wherein a lower end of the inner covering portion defines an opening which is configured to accommodate a protruding portion of the connector main body.

24. A combination comprising:

first and second connectors which are configured to mate with one another, wherein the first connector comprises:

a first connector main body, the first connector main body including mating guide portions formed at both ends longitudinally, the mating guide portions configured to mate with mating guide portions of the second connector, the first connector main body being formed of an insulating resin material;

first terminals mounted in the first connector main body; and a first reinforcing metal fitting molded into the first connector main body such that the first reinforcing metal fitting is not removable from the first connector main body, the first reinforcing metal fitting including an engaging protruding portion whose leading end portion is configured to engage with an engaging portion on the second connector, wherein a first portion of the first reinforcing metal fitting is covered by the insulating resin material, and wherein a second portion of the first reinforcing metal fitting, which second portion includes at least the leading end portion of the engaging protruding portion, is not covered by the insulating resin material, and wherein the second portion protrudes from a wall surface of one of the mating guide portions; and wherein the second connector comprises:

a second connector main body;

second terminals mounted in the second connector main body; and a second reinforcing metal fitting mounted to the second connector main body, wherein the second reinforcing metal fitting comprises:

a main body portion having first and second opposite ends;

a first L-shaped connecting arm portion, the first L-shaped connecting arm portion having a first rear end portion and a first forward end portion, wherein the first forward end portion extends generally perpendicularly forwardly from the first rear end portion, the first rear end portion being connected to the first end of the main body portion;

a second L-shaped connecting arm portion, the second L-shaped connecting arm portion having a second rear end portion and a second forward end portion, wherein the second forward end portion extends generally perpendicularly forwardly from the second rear end portion, the second rear end portion being connected to the second end of the main body portion, whereby inner surfaces of the first and second forward end portions face each other;

a first J-shaped side guide portion, the first J-shaped side guide portion having a first outer wall portion, a first inner wall portion and a first upper wall portion, the first outer wall portion extending forwardly from a forward end of the first forward end portion, the first upper wall portion extending inwardly from an upper surface of the first outer wall portion, the first inner wall portion extending downwardly from the first upper wall portion such that a lower surface of the first inner wall portion is positioned lower than a lower surface of the first outer wall portion, the first inner wall portion defining a first engaging recessed portion therein proximate to a forward end of the first inner wall portion; and a second J-shaped side guide portion, the second J-shaped side guide portion having a second outer wall portion, a second inner wall portion and a second upper wall portion, the second outer wall portion extending forwardly from a forward end of the second forward end portion, the second upper wall portion extending inwardly from an upper surface of the second outer wall portion, the second inner wall portion extending downwardly from the second upper wall portion such that a lower surface of the second inner wall portion is positioned lower than a lower surface of the second outer wall portion, the second inner wall portion defining a second engaging recessed portion therein proximate to a forward end of the second inner wall portion.

* * * * *